United States Patent [19]

Hetrick

[11] Patent Number: 5,021,762

[45] Date of Patent: Jun. 4, 1991

[54] THERMAL CYCLING SWITCH

[75] Inventor: George L. Hetrick, Mansfield, Ohio

[73] Assignee: Robertshaw Controls Company, Inc., Mansfield, Ohio

[21] Appl. No.: 562,270

[22] Filed: Aug. 3, 1990

[51] Int. Cl.[5] ..... H01H 61/08; H01H 71/16

[52] U.S. Cl. ..... 337/103; 337/41; 337/93

[58] Field of Search ..... 337/102, 103, 104, 105, 337/106, 107, 101, 113, 83, 93, 37, 38, 39, 41

[56] References Cited

U.S. PATENT DOCUMENTS

| | | | |
|---|---|---|---|
| 2,623,137 | 12/1952 | Vogelsberg . | |
| 3,110,789 | 11/1963 | Hild et al. . | |
| 3,634,802 | 1/1972 | Aldous | 337/101 |
| 4,337,451 | 6/1982 | Fox | 337/93 |
| 4,471,338 | 9/1984 | Holtkamp | 337/64 |

*Primary Examiner*—Harold Broome

*Attorney, Agent, or Firm*—Pearne, Gordon, McCoy & Granger

[57] ABSTRACT

A thermal cycling switch has an insulated housing carrying a centrally located rotating cam. The cam operates a first ON/OFF switch connectable between a pair of contacts that are connected to one side of a load and one power line. The rotary cam also moves an adjusted contact mounted on an adjustable arm which cooperates with a cyling arm contact to operate as another switch between the other side of the load and another power line. The cycling arm includes a bimetal member which is electrically insulated at the base, as well as a current conducting strip formed of pure nickel metal extending along the low expansion side of the bimetal member. The metal strip is heated by a separate resistance wire wrapped around an insulated cover on the metal strip and connected across the load so that whenever the load is energized from the power lines, the metal strip is heated to produce an initial biasing force causing the contacts to close in opposition to the thermal expansion of the bimetal, which tends to cause the contacts to open.

16 Claims, 4 Drawing Sheets

THERMAL CYCLING SWITCH

BACKGROUND OF THE INVENTION

This invention relates generally to thermal cycling switches of the type used for controlling resistance-type power loads, such as surface heating units of an electric cooking range, and more particularly to infinitely variable thermal cycling switches of the voltage-sensitive type.

Thermal cycling switches, also known as "infinite switches," use a rotating cam controlled by an external control knob to provide the actuation of switch elements inside an insulated housing, which is preferably made as small as possible consistent with safety requirements for easy mounting on control panels for range units. The rotating cam operates an ON/OFF switch for one of the lines, as well as the cycling switch, to provide complete electrical isolation of the power load when the switch is in the OFF position, and the cam may also operate contacts for a pilot light to show that power is connected to the load whenever the switch is in the ON position.

In one type of switch, the cam includes a variable cam surface which is adapted to move an adjusted contact on a contact arm to variable positions with respect to a cycling contact mounted on a cycling arm. The cycling arm includes a bimetal member that is heated whenever the cycling arm contact engages the adjusted contact to energize the power load. As the bimetal heats up, it tends to deflect the cycling arm away from the adjusted contact to break the circuit and stop the heating of the bimetal as well as the load. As the bimetal then cools, it moves the cycling contact back toward the adjusted contact to reconnect the circuit and reheat the bimetal and the load. The further the adjusted contact is positioned by the cam surface away from the normal position of the cycling contact under ambient temperature conditions, the longer the OFF or open circuit portion of the complete cycle. Generally, the cam surface is formed to provide an OFF position at which the adjusted contact is held permanently away from the cycling contact, and the cam surface progressively moves the adjusted contact all the way to a high or full ON position, at which the contacts remain in engagement at all times.

In an alternative type of thermal cycling switch, the contact corresponding to the adjusted contact may be in a fixed position, and the cam used to provide a variable bias to the cycling arm, which includes the bimetal member, to vary the force applied by the bimetal, and hence achieve a variable cycling relation for the cycling arm.

One problem with the latter type of switch with the fixed contact is that the gradual movement of the cycling arm under the heating and cooling of the bimetal tends to result in creep action between the contacts, which increases the likelihood of arcing and possible welding of the contacts. In switches of this type, it has been found necessary to use some form of snap action, either in the form of an overcenter spring or a magnet adjacent the stationary contact, to provide a snap action for opening and closing to eliminate the problems associated with contact creep.

On the other hand, in the case of switches of the former type, in which the adjusted contact is movable by a cam responsive to a control knob, it has been found possible to provide a snap action for the cycling bimetal arm by an arrangement first disclosed in U.S. Pat. No. 2,623,137, issued Dec. 23, 1952 to W. H. Vogelsberg. In this case, the current does not run through the bimetal itself but, rather, through a heater which is insulated from the bimetal and spaced therefrom along most of its length by the insulation. The bimetal is arranged so that the high expansion side carries the cycling contact which engages the adjusted contact, while the lower expansion side is adjacent the heater. When the contacts are closed, the full current to the power load goes through the heater strip, which is connected at the end to the bimetal adjacent the contact, so that the heater strip heats up more rapidly than the bimetal, which is not only electrically, but also thermally, insulated from the heater by the insulating strip. Since the heater is connected to the end of the bimetal and expands more rapidly than the bimetal, the initial heating action caused by expansion of the heater itself tends to deflect the bimetal in a direction against the high expansion side and move the contacts more closely together. Only after the heat has been applied for a sufficient time is the bimetal itself heated enough to overcome the action of the thermal expansion of the heater and cause the bimetal to deflect to move the cycling contact away from the adjusted contact to open the circuit and discontinue heating. As the heater and bimetal both cool, the cycling contact moves back toward engagement with the adjusted contact. A more commercial version of this type of switch is shown in U.S. Pat. No. 3,634,802, granted Jan. 11, 1972 to George C. Aldous, assigned to the assignee of the present invention and incorporated by reference herein. This patent shows additional ways of adjusting the action of the cycling contacts to provide the desired length of cycle and to provide compensation for changing ambient temperatures which would otherwise affect the cyclic operation of the bimetal member.

In the above type of switch, the current through the heater strip represents the full current passing through the load and, as a result, the characteristics of the switch must be adjusted to a given load in terms of current flow, since a higher or lower current flow required by a higher or lower wattage load will change the cyclic operation so that the settings of the switch at a given angular position are only repeatable for a given amperage of current, and hence given wattage of the power load that is being controlled.

The foregoing characteristics of such switches require that switches be matched to loads and, while this is not a matter of great difficulty on an assembly line, it does make a problem for replacement purposes since, in the case of surface units of electric ranges, different types of ranges may have surface units of substantially different wattage, depending upon the diameter of the surface unit, as well as whether or not it is a high or low powered unit for a given size. This requires that service personnel be supplied with a number of different switches for replacements in the field, which tends to result in a substantially increased inventory requirement. For this reason, it has been recognized as desirable to have a thermal cycling switch which is relatively insensitive to the wattage of the load. This can be accomplished as shown, for example, in the patent of H. F. Hild et al. U.S. Pat. No. 3,110,789, granted Nov. 12, 1963, by utilizing a heater arrangement which is in parallel rather than in series with the load, and therefore responsive only to the applied voltage rather than the current conducted by the switch. With this arrangement, no strip heater is used, but rather the bimetal member is sandwiched between an insulator, and then a low wattage, high resistance heater wire is wrapped around the insulated bimetal over a substantial length so that as the wire is heated, the resultant heat will be transmitted through the insulator to the bimetal member, which will then deflect to move the cycling contact with a snap action provided by the magnet at the stationary contact. The entire bimetal arm is biased by means of a second angularly extending arm, which may be formed of a compensating bimetal to correct for ambient conditions, and the force applied through still another cam follower arm from the rotary cam to provide a variable bias to the cycling arm to control the cycling action. However, with this arrangement, the component parts become more complex, as does the adjustment for the compensating bimetal, and the snap action depends upon a relatively small permanent magnet to retard the opening of the contacts during the cycling action.

SUMMARY OF THE INVENTION

According to the preferred embodiment of the present invention, a thermal cycling switch uses a cam-moved adjusted contact together with a cycling contact on a bimetal arm, where the heating action is provided by a high resistance heater connected in parallel with the load. The resulting construction provides the simplicity of the current-sensitive or series-type unit described above, together with a fast contact action providing a snap action, as has previously been done in a cycling switch in which all of the current through the load passes through a heater strip located adjacent to, but electrically insulated from, the bimetal arm. In this case, the heating is provided not by the current passing through the strip but, rather, by a high resistance coil wrapped around but electrically insulated from a metal strip extending along and insulated from the bimetal in the same manner as the heater strip in a current-sensitive switch. In this case, the metal strip does carry the current from the stationary terminal on the switch housing through the metal strip to the electrical contact carried by the bimetal arm, but the strip is made of sufficient size to offer substantially no resistance, and thereby providing insignificant heating action in itself. It has been found that pure metallic nickel is an excellent material for this strip, since it provides high electrical conductivity, and therefore low resistance, to minimize any heating effect from the current passing through the strip. At the same time, nickel provides a relatively high coefficient of thermal expansion as the strip is heated by the surrounding wire heater to ensure that the strip will expand initially more rapidly than the bimetal. This provides an initial biasing force on the cycling contact toward the adjusted contact until sufficient heat is transmitted to the bimetal member to cause the cycling contact to move in the opposite direction from the adjusted contact so that the switch opens to disconnect power from the load.

The resultant combination provides the desirable features of the series-type, current-sensitive cycling switch to provide an additional movement under heating action for the contacts to move more tightly together before they snap open after sufficient heating of the bimetal. The use of a heat source that is voltage-sensitive in that it is connected across the lines allows a high resistance so that its behavior is not affected by the size or wattage of the power load, and a single unit may function in substantially the same manner over a wide range of load current, and hence a large variation in the wattage rating of the particular heating unit.

DETAILED DESCRIPTION OF THE PREFERRED EMBODIMENT

The thermal cycling switch according to the present invention incorporates many structural features shown in the aforesaid U.S. Pat. No. 3,634,802, as well as other features disclosed in U.S. Pat. No. 4,471,338, granted Sept. 11, 1984 to Calvin J. Holtkamp and assigned to the assignee of the present invention, and incorporated by reference herein. It will be understood that both of these patents disclose current-sensitive type thermal cycling switches, but that they disclose other structural features equally applicable to the present invention.

Figure 1:
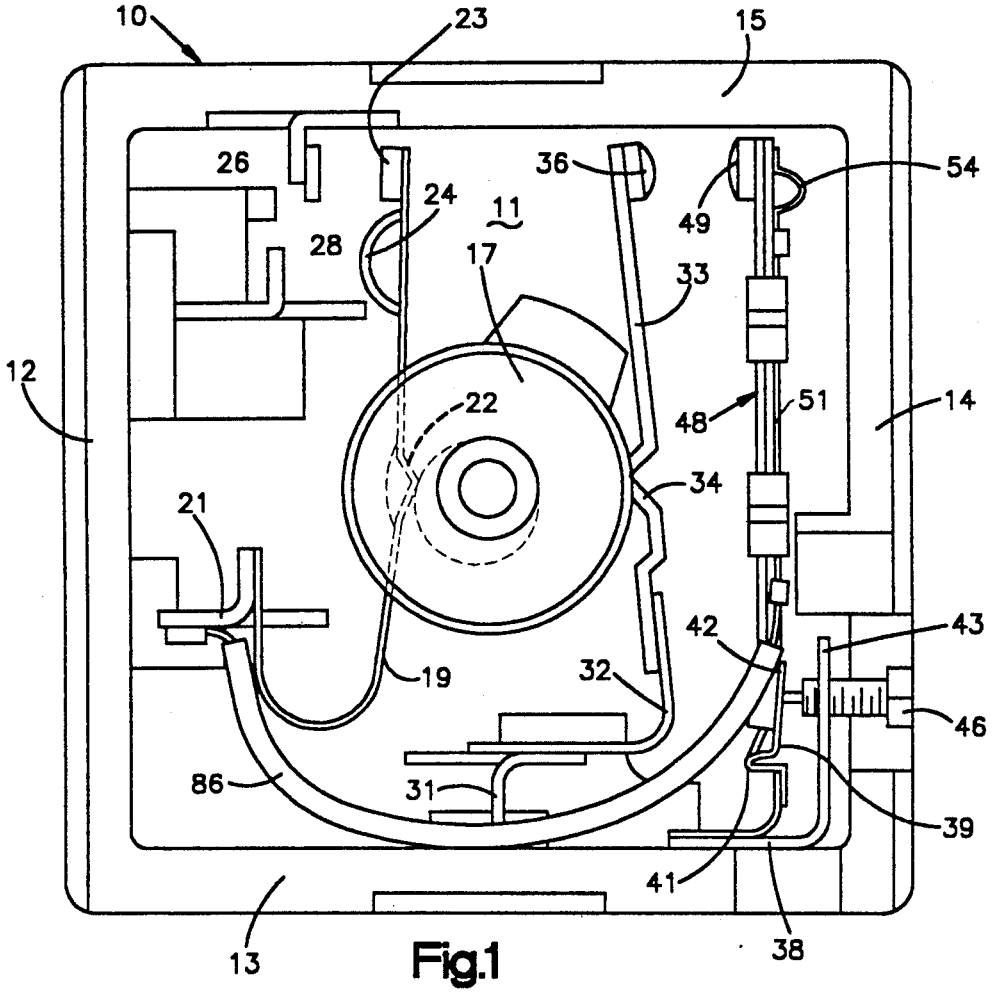
FIG. 1 is a top plan view of a thermal cycling switch according to the present invention, with the cover and shaft portions removed to show the interior.
Figure 6:
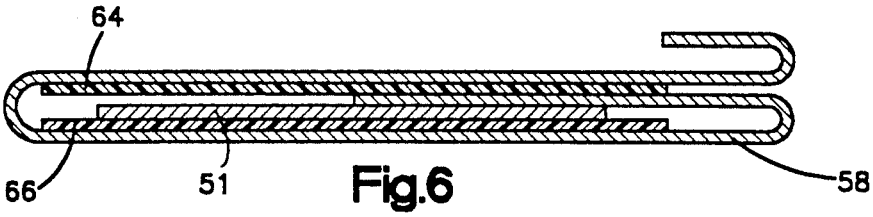
FIG. 6 is a cross-sectional view taken along line 6—6 of FIG. 3.
Figure 7:
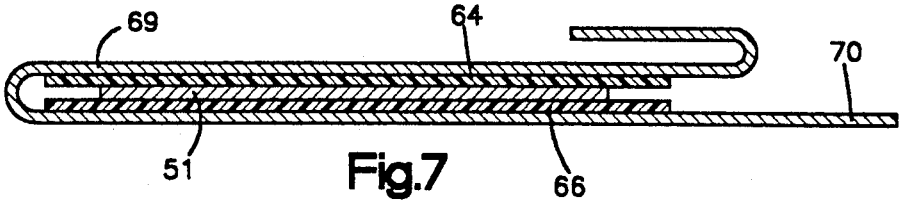
FIG. 7 is a cross-sectional view taken on line 7—7 of FIG. 3.
Figure 2:
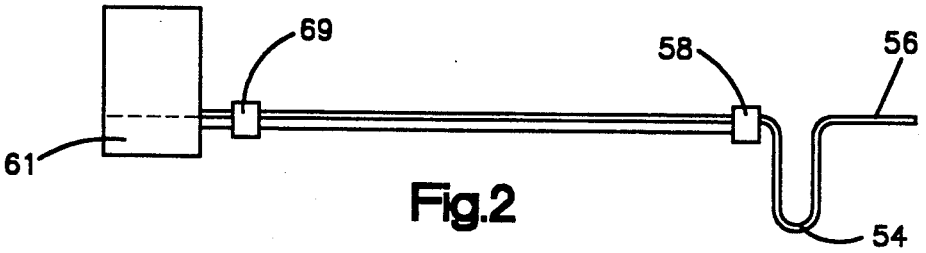
FIG. 2 is a fragmentary plan view of portions of the cycling arm after partial assembly.
Figure 3:
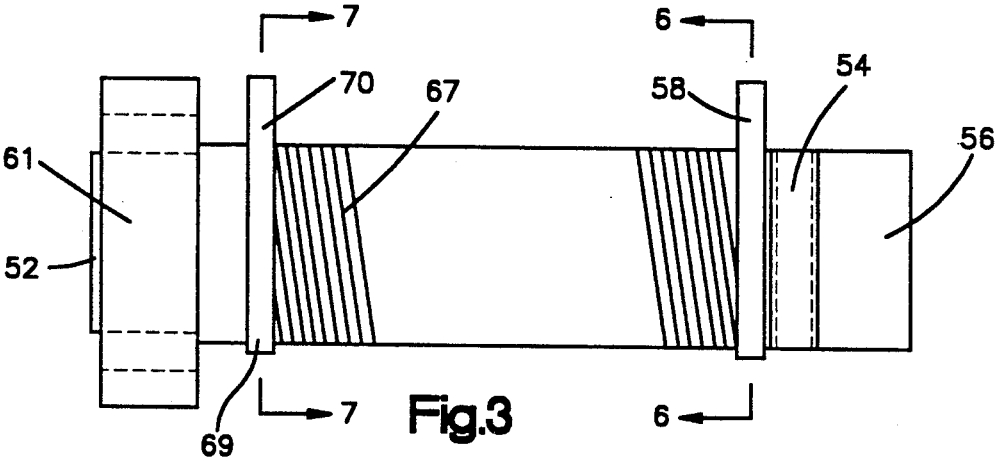
FIG. 3 is a side elevational view of the partially assembled cycling arm prior to assembly with the bimetal.

Referring now to the drawings in greater detail, and particularly to FIG. 1, the cycling switch includes a casing 10 having a base wall 11 and left, front, right, and rear vertically extending walls 12, 13, 14, and 15, respectively, which extend upward from the base wall 11 to define a cavity which is covered by a suitable cover (not shown), which seals the cavity and provides means for mounting the switch, as well as a bearing for a control shaft, as disclosed in the aforesaid reference U.S. Pat. No. 4,471,338.

A rotary cam 17 is mounted in the center of casing 10 with a bearing on the base wall 11 to be rotatable about an axis perpendicular to the base wall continuously through an arc of 360 degrees. The cam 17 has peripheral cam surfaces which serve as radial cams to actuate the switch units mounted within the casing 10. These switch units control the two lines from a power source to an electrical resistance load such as a surface unit heater of an electric range, and two switches are used so that in the OFF position, the load is completely isolated from both of the power lines. Thus, a first switch arm 19 has a free end connected to a terminal 21 mounted on the base wall 11 and projecting to the exterior to receive an electrical connector, as disclosed in the aforesaid patents. The terminal 21 is normally connected to one side of the heater load, and switch arm 19 is in the form of a spring arm having a follower portion 22 adjacent its midpoint which engages the cam surface on cam 17. At the other end, switch arm 19 carries an electrical contact 23 and a spring loop 24. Contact 23 engages a similar contact on terminal 26 connected to one side of the power supply, while the spring loop 24 engages a third terminal 28 connected to a pilot light. The use of the spring loop 24 for the relatively low current power required for the pilot light allows this contact to deflect and ensure positive engagement between the contact 23 and terminal 26. The cam surface on cam 17 engaged by the follower portion 22 is so configured that the contact 23 and loop 24 are disengaged as shown in FIG. 1 only when the rotary cam 17 is in the OFF position. As soon as the cam is moved any distance from the OFF position to even a low ON position, the contacts 23 and 24 are closed and will remain closed through the remainder of the rotation of cam 17 to other power level settings.

The other power supply line is connected to another terminal 31, also mounted on the back wall 11, and projecting therethrough for external connection. The terminal 31 has welded to it one side of the hinge spring 32, which is also welded to a rigid adjustable arm 33 extending across the interior casing 10 and carrying a cam follower portion 34 in contact with the rotary cam 17. At its opposite end, arm 33 supports an adjusted contact 36 so that as the cam 17 is rotated, the adjusted contact 36 is moved toward and away from the right wall 14 with the position farthest away from the wall 14 corresponding to an OFF position and the position closest to the wall 14 being the high position.

To complete the circuit, the other side of the load, such as the electrical range surface unit, is connected to a terminal 38, also rigidly mounted on the back wall 11. Terminal 38 also serves to support one side of a spring hinge 39, which includes a loop portion 41 for flexing at a given point and a free end 42. The free end 42 is connected to a cycling arm 48 extending generally parallel to adjustable arm 33 and carrying a cycling contact 49 engageable with the adjusted contact 36, as described in greater detail hereinafter. Also mounted on the terminal 38 is a compensating bimetal member 43 which carries a calibrating screw 46 engageable with the base of cycling arm 48. Adjacent the free end 42 is spring hinge 39 for ambient temperature compensation, as describe in the aforesaid U.S. Pat. No. 3,634,802.

Figure 4:
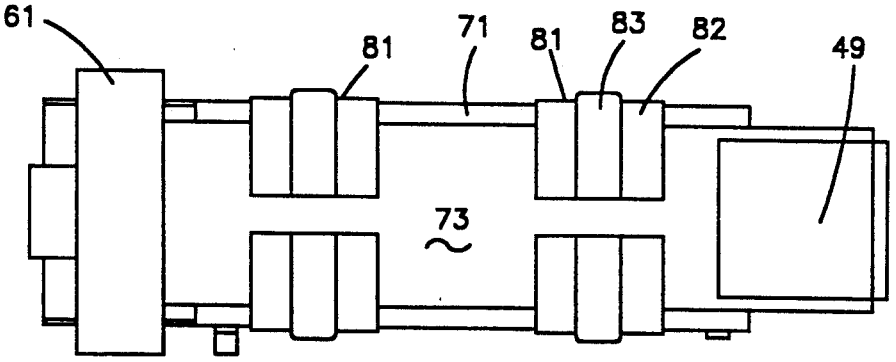
FIG. 4 is an elevational view of the fully assembled cycling arm.
Figure 5:
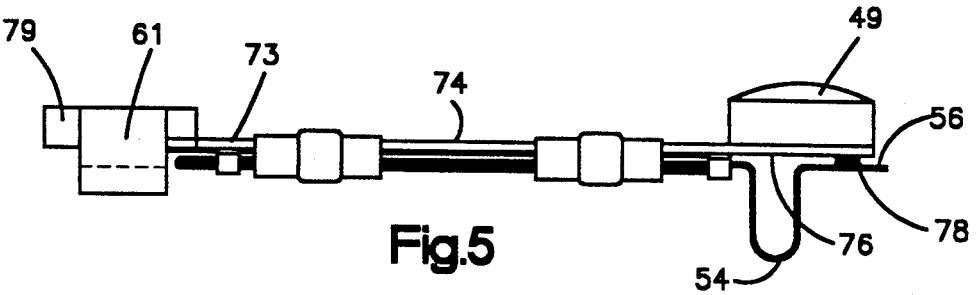
FIG. 5 is a top plan view of the arm shown in FIG. 4.
Figure 8:
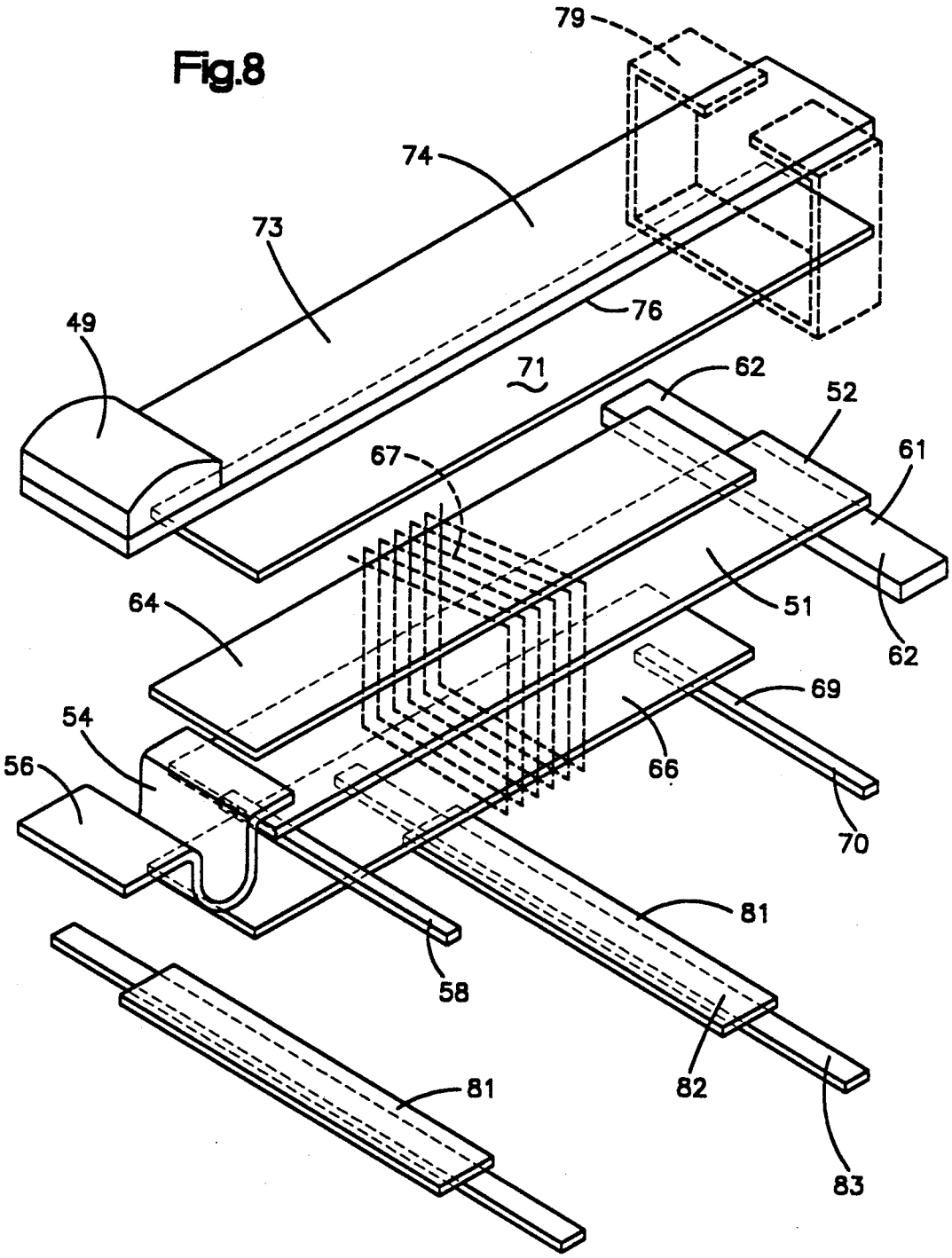
FIG. 8 is an exploded view including parts prior to assembly of the component parts of the cycling arm.

The cycling arm 48 is best shown in detail in FIG. 8, which is an exploded view of the component parts prior to complete assembly, aas well as in FIGS. 4 and 5, which are views of the complete cycling arm. The arm includes a conducting strip or strap 51 having a base portion 52 at one end and having the other end welded to a loop spring 54 having a free tip portion 56 on the other side of the loop from the conducting strip 51. The conducting strip 51 is preferably made from pure nickel metal because of its resistance to corrosion, as well as its relatively high coefficient of thermal expansion and relatively high conductivity. Because of the high conductivity, the strip can carry a relatively high electrical current without heating from that current but still allows a relatively large amount of thermal expansion when the strip is heated from the exterior heater, as described hereinafter. The loop spring 54 is preferably made from a suitably hardened stainless steel alloy and operates to utilize the expansion of the conducting strip 51 to apply a biasing force on the cycling arm 48, as described hereinafter.

A terminal strip 58, which may be formed of a suitable material such as a nickel-chromium alloy, is welded to the conducting strip 51 adjacent the loop spring 54 and projects out laterally for a distance of several times the width of the strip 51. A base clamp 61 is welded to the base portion 52 of the conducting strip on the same side as the projecting loop of loop spring 54, and has a pair of projecting ends 62. This base clamp 61, after the arm has been assembled, is then welded to the free end 42 of spring hinge 39 so that current from the terminal 38 can flow through the spring hinge 39 and base clamp 61 to the one end of conducting strip 51, and from there through the loop spring 54 to the tip 56.

The conducting strip 51 is sandwiched between a pair of mica paper insulators 64 and 66, which are formed to have a length substantially equal to the distance between the base clamp 61 and the loop spring 54, and are slightly wider than the conducting strip 51, so that they effectively cover all of the central portion of the conducting strip 51. The heater wire 67, which may be a relatively small diameter nichrome wire having a relatively long length, and therefore relatively high resistance, is wrapped around the sandwich of the two sheets of mica paper 64 and 66 with the conducting strip 51 in between. For example, the heater wire may be of a nickel-chromium alloy with an insulated oxide coating to have a 0.001 inch diameter and a total length of about 24 feet, giving a total resistance of 16,000 ohms, so that when a line voltage of 220 to 240 volts is applied to the heater, it effectively generates heat in a range of about 3 to 4 watts, and this heat is conducted through the mica paper sheets 64 and 66 to heat the conducting strip 51. At its one end, the heater wire coil 67 is connected to the terminal strip 58, which is wrapped around the mica paper sheets 64 and 66 to hold them in place at one end on the conducting strip 51, and since the terminal strip 58 is welded to the conducting strip 51 adjacent loop spring 54, the current flow through the heater wire is also through the terminal strip 58 and through conducting strip 51 to the loop spring tip 56. At its other end, the heater wire coil 67 is secured to a free terminal 69 similar in material and shape to terminal strip 58, but insulated from the conducting strip 51 and wrapped around the mica paper sheets 64 and 66 adjacent the base clamp 61 to hold the assembly in place at that end, and terminal 69 has a projecting end 70 (see FIG. 4) for making an electrical connection as described hereinafter.

A third mica paper sheet 71 of greater length and width than sheets 64 and 66 is then placed on the one side of the assembly on top of the heater wire coil 67 and spaced by that coil from the top mica paper sheet 64, while the other side of sheet 71 is placed against a bimetal arm 73. Bimetal arm 73 extends between the area of base clamp 61 and loop spring tip 56 and has a high expansion side 74 on the side of the strip away from the heater coil 67 and a low expansion side 76 adjacent the mica paper sheet 71. The cycling arm contact 49 is welded to the high expansion side of bimetal arm 73 adjacent the tip and on the opposite side from the loop spring tip 56, while the latter is welded to the low expansion side 78 on the other side of the bimetal arm 73 from the contact 49. A suitable glass cloth insulator 79 is wrapped around the end of bimetal arm 73 within the base clamp 61, and after these parts have been assembled, the base clamp ends 62 are folded over through a 180-degree bend to hold the assembly in place at the base end. It should be noted that since the bimetal arm 73 makes contact at the base end only with the glass cloth insulator 79, it is electrically and thermally insulated from the conducting strip 51 and base clamp 61. To further hold the assembly in place, suitable fastening means such as straps 81 are wrapped around the midpoint of the assembly, and include an insulating member 82 and soft brass strap 83 to hold the straps in place. When the cycling arm 48 is mounted on the spring hinge 39, and hence terminal 38, a connecting wire 86 is welded or soldered at each end between the free terminal projecting end 70 and heater terminal 21, as shown in FIG. 1.

Figure 9:
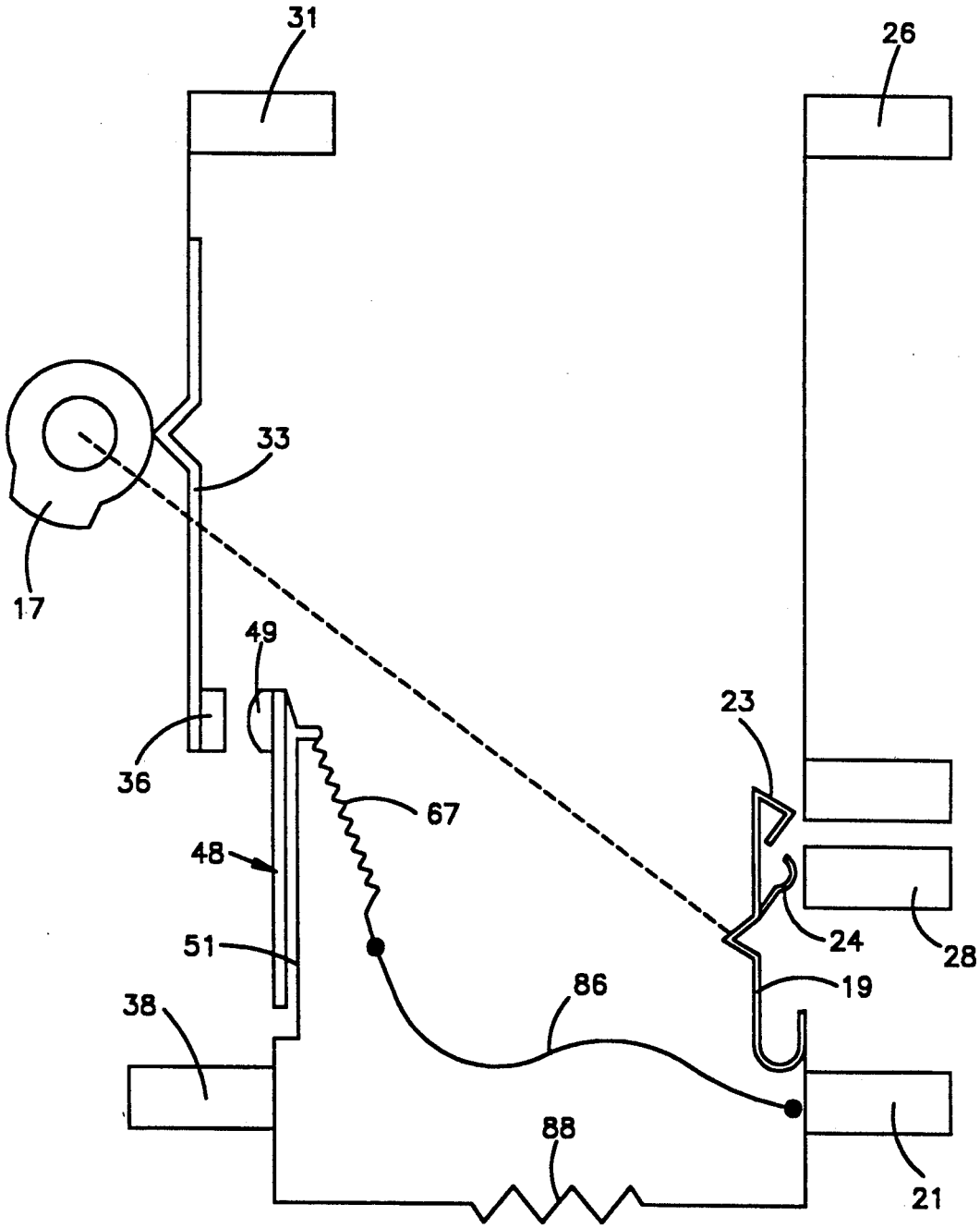
FIG. 9 is a schematic view showing a typical circuit using the thermal cycling switch of the present invention.

The circuit for the switch as connected to a resistant heating load and line is shown in FIG. 9. The terminals 26 and 31 are connected to the power supply lines, such as a standard 220-volt AC line that might be used to supply an electric range. The connection from the terminal 26 is through the contact 23 and switch arm 19 to load terminal 21, which is connected to one side of the resistance heating load 88, such as an ordinary electric surface unit whose other side is connected to the other load terminal 38. This terminal is connected through the cycling arm 48, and more particularly through the conducting strip 51, to the cycling contact 49, which is engageable with the adjusted contact 36 on adjusted arm 33, which in turn is connected back to the other line terminal 31.

In operation, as long as the adjusted contact 36 is spaced away from the cycling contact 49, no current will pass through the switch. When the rotary cam 17 is in the OFF position, this will always be the case and contact 23 is also out of engagement with the terminal 26 so that the load 88 is completely disconnected from the terminals 26 and 31. When the rotary cam 17 is rotated to a position away from OFF, the contact 23 engages the terminal 26 so that terminal 26 remains connected to one side of the load 88 at all times other than when the switch is off. The shape of the rotary cam 17 and the adjusted arm 33 is such that as soon as the switch is moved to an ON position, the adjusted contact 36 is moved into electrical contact with the cycling contact 49 and this completes the connection through both sides of the switch to ensure that both sides of load 88 are now connected to the terminals 26 and 31, and hence the supply line.

It should be noted that as long as cycling contact 49 remains in contact with adjusted contact 36, the full voltage applied to the terminals 26 and 31 is therefore applied, through connecting wire 86, to the heater wire 67, which is connected in parallel across the load 88. The entire voltage drop in this line takes place across the heater wire 67, which therefore rises in temperature. The heat from heater wire 67 is thus conducted through the two mica paper sheets 64 and 66 to the conducting strip 51, which therefore becomes heated from this source, independently of any minor amount of heating that may occur from the current flowing through the conducting strip 51, since the strip has an extremely low resistance. This heating of the strip 51 causes it to expand lengthwise, and since the base is fixed by the base clamp 61, the expansion is taken up by the loop spring 54, and therefore applies a biasing force to the tip 56. Since the latter is welded to the end of the bimetal arm 73, the arm tends to bend upwardly as shown in FIG. 8 and thereby moves the cycling contact 49 even more tightly into engagement with the adjusted contact 36.

At the same time that the above is happening, some of the heat from the heater wire 67 is conducted through the mica paper sheet 71 to the bimetal arm 73 to thereby heat both the high and low expansion sides 74 and 76, respectively. However, it will be understood that the amount of heat transferred to the bimetal arm 73 is less than that to the conducting strip 51, since the heater wire, in effect, through the mica paper sheets 64 and 66, engages both sides of the strip 51, which is thinner and lower in mass than the bimetal arm 73, so that the bimetal arm 73 receives less heating energy and has more mass than the conducting strip 51. However, after sufficient heat has been applied, because of the bending action of the bimetal arm 73 due to the greater expansion of the high expansion side 74 over the lower expansion side 76, the bimetal arm will bend and deflect so that the cycling contact 49 is moved downward (as shown in FIG. 8) and thereby move the cycling contact 49 out of engagement with the adjusted contact 36 to open the circuit. This opening of the circuit not only disconnects the load 84 from the supply line, but also disconnects the heater wire 67, since it is on the load side of the cycling contact 49. This movement of the cycling contact 49 will tend to occur rather abruptly as the increasing forces on the bimetal arm overcome the forces from the expansion of the conducting strip 51 as applied to the loop spring 54. This abrupt opening of the cycling contact 49 provides a rapid action to minimize arcing between the cycling contact 49 and the adjusted contact 36, and tends to provide the same action in a voltage-sensitive switch as that provided in a current-sensitive switch such as that shown in the aforesaid U.S. Pat. No. 3,634,802. Thus, the heating action of wire 67 is independent of the current passing through the load 88 and responsive solely to the voltage applied to the terminals 26 and 31.

Although the preferred embodiment of this invention has been shown and described, it should be understood that various modifications and rearrangements of the parts may be resorted to without departing from the scope of the invention as disclosed and claimed herein.

What is claimed is:

1. A thermal cycling switch for controlling the cyclic operation of an electrical load from first and second power lines, said load having first and second terminals, means connecting said second terminal to said second power line, a first contact connected to said first power line, a cycling arm having a fixed end connected to said first terminal and a movable end carrying a second contact cyclically engageable with said first contact, said cycling arm comprising a bimetal member extending between said fixed end and said second contact, means electrically insulating said bimetal member from said fixed end, said bimetal member having a high expansion side and a low expansion side, said second contact being on said high expansion side of said bimetal member, a metal strip extending along said low expansion side of said bimetal member and being electrically insulated therefrom, said metal strip being electrically connected to said fixed end and said second contact, and a high resistance heating element in heating relation with said metal strip and being connected at one end to said second contact and at the other end to said second terminal so that said metal strip is heated by said heating element by current in parallel with said load whenever said first and second contacts are in engagement.

2. A thermal cycling switch as set forth in claim 1, including insulating sheets on both sides of said metal strip, and wherein said heating element is a resistance wire wrapped around said strip and said insulating sheets.

3. A thermal cycling switch as set forth in claim 2, including a spring loop at the end of said metal strip adjacent said second contact so that thermal expansion of said metal strip compresses said loop to apply force urging said second contact toward said first contact.

4. A thermal cycling switch as set forth in claim 3, wherein the position of said first contact relative to said cycling arm is adjustable.

5. A thermal cycling switch as set forth in claim 3, wherein said metal strip is formed of nickel.

6. A thermal cycling switch for controlling the cyclic operation of an electrical load from first and second power lines, said load having first and second terminals, means connecting said second terminal to said second power line, a first contact connected to said first power line and a second contact connected to said first terminal to connect said first power line to said first terminal when said first and second contacts are in engagement, means positioning said first contact at a predetermined adjusted position, a cycling arm having a fixed end and a movable end, said movable end carrying said second contact for cyclical engagement with said first contact, said cycling arm comprising a bimetal member extending between said fixed end and said second contact, means electrically insulating said bimetal member from said fixed end, said bimetal member having a high expansion side and a low expansion side, said second contact being on said high expansion side of said bimetal member, a metal strip extending along said low expansion side of said bimetal member and being electrically insulated therefrom, said metal strip being electrically connected to said fixed end and said other contact, and a high resistance heating element surrounding said metal strip and being connected at one end to said other contact so that said metal strip is heated by said heating element by current in parallel with said load whenever said first and second contacts are in engagement.

7. A thermal cycling switch as set forth in claim 6, wherein said positioning means for said first contact is a rotary cam.

8. A thermal cycling switch as set forth in claim 7, including a switch in said means connecting said second terminal to said second power line and said switch is operated by said rotary cam.

9. A thermal cycling switch as set forth in claim 7, wherein said first contact is carried on an adjustable arm extending generally parallel to said cycling arm.

10. A thermal cycling switch as set forth in claim 9, wherein said rotary cam engages said adjustable arm adjacent its midpoint.

11. A thermal cycling switch for controlling the cyclic operation of an electrical load comprising a housing, a cam rotatably mounted on said housing and having at least one cam surface, first and second terminals mounted on said housing, one of said terminals being connected to one side of said load, a spring arm having a fixed end connected to said first terminal and a movable end supporting an adjusted contact, means on said spring arm engageable with said cam surface to move said adjusted contact with respect to said housing, a cycling arm having a fixed end connected to said second terminal and a movable end supporting a cycling contact engageable with said adjusted contact, said cycling arm comprising a bimetal member extending between said fixed end and said movable end, means electrically insulating said bimetal from said fixed end, said bimetal member having a high expansion side and a low expansion side, said cycling contact being on said high expansion side of said bimetal member, a metal strip extending along said low expansion side of said bimetal member, said metal strip being electrically connected to said second terminal and to said cycling contact, and a high resistance heating element in heating relationship with said metal strip and being connected at one end to said cycling contact and at the other end to the other side of said load, so that said metal strip is heated by said heating element in parallel with said load whenever said cycling and adjusted contacts are in engagement.

12. A thermal cycling switch as set forth in claim 11, wherein said heating element surrounds said metal strip and is insulated therefrom.

13. A thermal cycling switch as set forth in claim 12, wherein said metal strip is insulated by sheets of insulation covering both sides of said strip and said heating element is a wire wrapped around said sheets.

14. A thermal cycling switch as set forth in claim 13, including insulating means insulating said heater wire from said bimetal member.

15. A thermal cycling switch as set forth in claim 14, including fastening means for holding said bimetal arm, said metal strip, said heater wire, and said insulating sheets together as a unit.

16. A thermal cycling switch as set forth in claim 11, wherein said metal strip is formed of nickel.

* * * * *